US010474066B1

(12) United States Patent
Tatsumi

(10) Patent No.: US 10,474,066 B1
(45) Date of Patent: Nov. 12, 2019

(54) DEVELOPER STIRRING MEMBER, DEVELOPER REPLENISHING UNIT, IMAGE FORMING APPARATUS

(71) Applicant: KYOCERA Document Solutions Inc., Osaka-shi, Osaka (JP)

(72) Inventor: Eiji Tatsumi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/423,396

(22) Filed: May 28, 2019

(30) Foreign Application Priority Data

Jun. 6, 2018 (JP) ..... 2018-108198

(51) Int. Cl.
*G03G 15/08* (2006.01)
*G03G 21/16* (2006.01)

(52) U.S. Cl.
CPC ..... *G03G 15/0889* (2013.01); *G03G 15/0891* (2013.01); *G03G 21/1647* (2013.01); *G03G 2215/085* (2013.01)

(58) Field of Classification Search
None
See application file for complete search history.

(56) References Cited

FOREIGN PATENT DOCUMENTS

JP 2013246268 A 12/2013

*Primary Examiner* — Roy Y Yi
(74) *Attorney, Agent, or Firm* — Alleman Hall Creasman & Tuttle LLP

(57) ABSTRACT

A developer stirring member includes a shaft member and a flexible member. The shaft member is elongated along a first direction inside a container. The film-like flexible member is supported by the shaft member and stirs the developer. The flexible member includes a base portion, a plurality of short piece portions, and a long portion. The base portion, elongated in the first direction, is fixed to the shaft member. The short piece portions, each extending from the base portion in a second direction that intersects the first direction, are juxtaposed in the first direction with spaces therebetween. The long portion is elongated in the second direction, longer in the second direction than the short piece portions, and extends from spaces in the base portion that are in between where the short piece portions are connected thereto.

20 Claims, 9 Drawing Sheets

DEVELOPER STIRRING MEMBER, DEVELOPER REPLENISHING UNIT, IMAGE FORMING APPARATUS

INCORPORATION BY REFERENCE

This application is based upon and claims the benefit of priority from the corresponding Japanese Patent Application No. 2018-108198 filed on Jun. 6, 2018, the entire contents of which are incorporated herein by reference.

BACKGROUND

The present disclosure relates to a developer stirring member, a developer replenishing unit, and an image forming apparatus.

The electrophotographic image forming apparatus includes print processing portions such as an image-carrying member, a charging device, a developing device, and a transfer device. Furthermore, the image forming apparatus includes the developer replenishing unit for replenishing the developing device with developer.

The developer replenishing unit includes a container for storing the developer, in which the developer stirring member and a conveying screw are provided. The developer stirring member stirs the developer by being rotationally driven inside the container. The conveying screw feeds out the developer from the container to the developing device.

The developer stirring member includes a shaft member that is rotatably supported inside the container, and a flexible member that is supported by the shaft member. The flexible member revolves in conjunction with rotation of the shaft member. The flexible member is a film material that stirs the developer by revolving.

The flexible member, while stirring the developer, uses its elasticity to flick up the developer to the conveying screw from below. In addition, there are known two rotatable sheet bodies that are provided inside the container.

SUMMARY

A developer stirring member according to an aspect of the present disclosure includes a shaft member and a flexible member. The shaft member is elongated in a first direction and rotatably supported inside a container for storing powdery developer. The film-like flexible member is supported by the shaft member and configured to stir the developer. The flexible member includes a base portion, a plurality of short piece portions, and a long portion. The base portion is elongated in the first direction and fixed to the shaft member. The plurality of short piece portions, each extending from the base portion in a second direction that intersects the first direction, are juxtaposed in the first direction with spaces in between one another. The long portion is elongated in the second direction, has a length that is longer in the second direction than the short piece portions, and extends from portions of the base portion that are in between where the short piece portions are connected to the base portion. The base portion, the short piece portions, and the long portion are made of one sheet of film material.

A developer replenishing unit according to another aspect of the present disclosure includes a container, the developer stirring member, and a developer feeding member. The container configured to store powdery developer. The developer stirring member is configured to stir the developer by being rotationally driven inside the container. The developer feeding member is configured to feed out the developer from the container by being rotationally driven inside the container. The plurality of short piece portions are each formed having a length such that the short piece portion does not come in contact with an inner surface of the container.

An image forming apparatus according to another aspect of the present disclosure includes a developing device, and the developer replenishing unit for replenishing the developing device with developer. The developing device is configured to develop, using developer, an electrostatic latent image on a surface of an image-carrying member.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 4A shows the developer stirring member in operation when the remaining amount of developer is low, and FIG. 4B shows the developer stirring member in operation when the remaining amount of developer is high.

DETAILED DESCRIPTION

Figure 1:
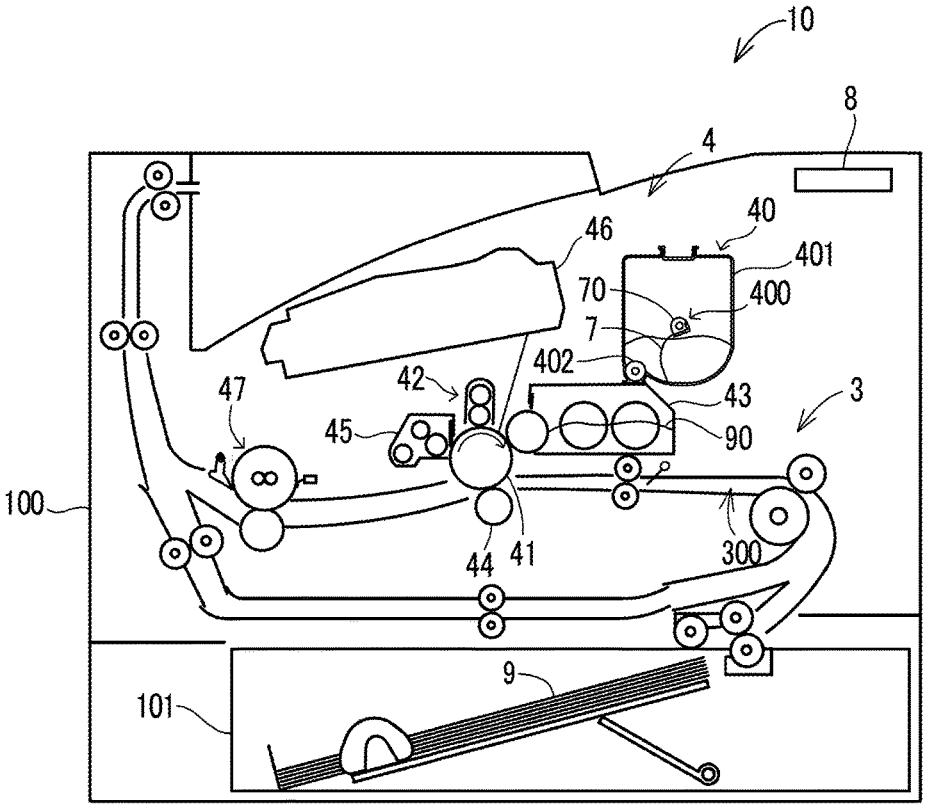
FIG. 1 is a diagram showing a configuration of an image forming apparatus according to a first embodiment.

The following describes an embodiment of the present disclosure with reference to the accompanying drawings. It should be noted that the following embodiment is an example of a specific embodiment of the present disclosure and should not limit the technical scope of the present disclosure.

[Configuration of image forming apparatus 10]

A developer stirring member 400 according to a first embodiment is included in a developer replenishing unit 40 of an electrophotographic image forming apparatus 10.

The image forming apparatus 10 includes a print processing portion 4 for executing an electrophotographic print process. The print process is for forming an image on a sheet 9. The sheet 9 is a sheet-like image forming medium such as a print sheet or a resin film.

As shown in FIG. 1, the image forming apparatus 10 includes, inside a body 100, a sheet conveying mechanism 3, the print processing portion 4, and a control device 8.

The control device 8 is configured to execute various types of data processes, and to control electric devices included in the image forming apparatus 10. The electric devices include a motor for rotationally driving the developer stirring member 400.

The sheet conveying mechanism 3 is configured to send out a sheet 9 from a sheet storing portion 101, where the sheet 9 is stored, to the sheet conveyance path 300, and to convey the sheet 9 along the sheet conveyance path 300.

The print processing portion 4 includes a photoconductor 41, a charging device 42, a developing device 43, a transfer device 44, a cleaning device 45, a light scanning unit 46, and a fixing device 47.

The drum-like photoconductor 41 rotates, and the charging device 42 is configured to charge the surface of the photoconductor 41. The light scanning unit 46 is configured to write an electrostatic latent image on the surface of the photoconductor 41 by scanning a light beam on the charged surface of the photoconductor 41.

The developing device 43 is configured to develop the electrostatic latent image by supplying a powdery developer 90 onto the surface of the photoconductor 41. The developer 90 is toner.

The transfer device 44 is configured to transfer, to the sheet 9 moving along the sheet conveyance path 300, the image of the developer 90 that is carried by the photoconductor 41. It is noted that the photoconductor 41 is an example of an image-carrying member. The fixing device 47 is configured to fix, to the sheet 9, the image of the developer 90 that is on the sheet 9.

The cleaning device 45 is configured to remove the developer 90 that is remaining on the surface of the photoconductor 41. The developer replenishing unit 40 is configured to replenish the developing device 43 with the developer 90. The developer replenishing unit 40 is removably attached to the body 100 of the image forming apparatus 10.

The developer replenishing unit 40 includes a container 401 in which the developer 90 is stored, and the developer stirring member 400 and a conveying screw 402 that are provided inside the container 401.

The developer stirring member 400 is configured to stir the developer 90 by being rotationally driven inside the container 401. The conveying screw 402 is configured to feed out the developer 90 from the container 401 to the developing device 43 by being rotationally driven. It is noted that the conveying screw 402 is an example of a developer feeding member.

The developer stirring member 400 includes a shaft member 70 that is rotatably supported inside the container 401, and a flexible member 7 that is supported by the shaft member 70. The flexible member 7 revolves in conjunction with rotation of the shaft member 70. The flexible member 7 is a film-like member configured to stir the developer 90 by revolving.

The flexible member 7 is made by forming, for example, a synthetic resin such as PET (polyethylene terephthalate) in a film-like shape. Accordingly, the flexible member 7 is flexible. It is noted that the flexible member 7 may be made by forming another synthetic resin, such as vinyl chloride or polycarbonate, in the film-like shape.

The flexible member 7, while stirring the developer 90, uses its elasticity to flick up the developer 90 to the conveying screw 402 from below.

Meanwhile, when a large amount of developer 90 is stored inside the container 401, a conventional film-like flexible member has a risk of lacking enough elasticity with respect to the weight of the developer 90. In this case, the flexible member does not sufficiently stir and flick up the developer 90.

In addition, in the case where film material with a large thickness is adopted for the flexible member, when the amount of developer 90 inside the container 401 is low, the flexible member strongly comes in contact with the inner surface of the container 401 or the conveying screw 402.

The sound that is generated when the flexible member strongly comes in contact with the inner surface of the container 401 or the conveying screw 402 is an unpleasant noise.

In the developer replenishing unit 40 of the image forming apparatus 10, regardless of the amount of developer 90 stored inside the container 401, the developer stirring member 400 is capable of stirring the developer 90 inside the container 401 with an appropriate elastic force, while preventing the unpleasant noise. In the following, the developer stirring member 400 is described in detail.

Hereinafter, the longitudinal direction of the shaft member 70 is referred to as a first direction D1. The shaft member 70 is formed elongated along the first direction D1.

In addition, a direction that intersects the first direction D1 is referred to as a second direction D2. The second direction D2 shown in the drawings is the direction that is perpendicular to the first direction D1. However, the second direction D2 may be a direction that intersects the first direction D1 at an acute angle.

First Embodiment: Developer Stirring Member 400

The flexible member 7 of the developer stirring member 400 is configured by one sheet of film material. The flexible member 7 includes a base portion 71, a plurality of short piece portions 72, and a long portion 730.

That is, the base portion 71, the short piece portions 72, and the long portion 730 are configured by the one sheet of film material. In the present embodiment, the one sheet of film material has a rectangular shape.

The short piece portions 72 are divided by a plurality of cuts 74. The long portion 730 is divided into a plurality of long piece portions 73 by the cuts 74. The base portion 71 is connected with the short piece portions 72 and the long piece portions 73.

The cuts 74 include a plurality of first cuts 74*a* and a plurality of second cuts 74*b*. The first cuts 74*a* divide the short piece portions 72 from the long portion 730. The second cuts 74*b* divide the long portion 730 into the long piece portions 73. That is, the second cuts 74*b* divide the long piece portions 73 from one another.

Figure 3:
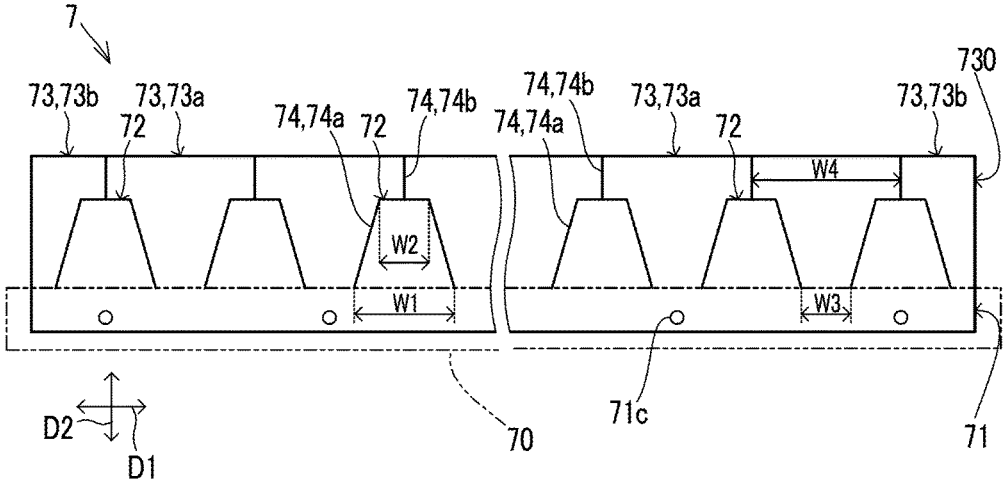
FIG. 3 is a partially abridged front diagram showing a flexible member included in the developer stirring member according to the first embodiment.

The base portion 71 is formed elongated in the first direction D1 and is fixed to the shaft member 70. In FIG. 3, the shaft member 70 is shown with an imaginary line (two-dot chain line). A plurality of holes 71*c*, in which unshown protruding portions of the shaft member 70 are inserted, are formed in the base portion 71.

The short piece portions 72 are each formed elongated in the second direction D2 from the base portion 71. In addition, the short piece portions 72 are formed juxtaposed in the first direction D1 with spaces therebetween.

FIG. 3 shows a first width W1 and a second width W2 of the short piece portion 72. The first width W1 is the size in the first direction D1 of a root portion, of the short piece portion 72, that is connected with the base portion 71. The second width W2 is the size in the first direction D1 of an end portion, of the short piece portion 72, on the opposite side of the base portion 71.

Furthermore, FIG. 3 shows a third width W3 and a fourth width W4 of the long piece portion 73. The third width W3 is the size in the first direction D1 of a root portion, of the long piece portion 73, that is connected with the base portion 71. The fourth width W4 is the size in the first direction D1 of an end portion, of the long piece portion 73, on the opposite side of the base portion 71.

The first width W1 is wider than the second width W2. In the present embodiment, all of the short piece portions 72 have a trapezoidal shape. That is, the short piece portion 72 is formed in a way that its size in the first direction D1 becomes narrower as it extends in the second direction D2 from the root portion on the base portion 71 side, toward the end portion on the opposite side.

It is noted that portion of the short piece portion 72 may have a trapezoidal shape, and the other portion may have a rectangular shape.

In addition, another shape may be adopted as a shape of the short piece portion 72 whose first width W1 is wider than the second width W2. For example, the short piece portion 72 may have a half-circle shape or a semi-ellipsoid shape.

The long piece portions 73 are formed elongated in the second direction D2 and extending from portions in the base portion 71 that are between the portions where the base portion 71 is connected with the short piece portions 72. That is, the long portion 730 is formed elongated in the second direction D2 and extending from portions in the base portion 71 that are between the portions where the base portion 71 is connected with the short piece portions 72. The long piece portions 73 are formed longer in the second direction D2 than the short piece portions 72. That is, the long portion 730 is formed longer in the second direction D2 than the short piece portions 72.

The second cuts 74*b* each cut into the long portion 730 from its end portion that is on the opposite side of the base portion 71, toward the base portion 71. Accordingly, the end portions of the long piece portions 73 are formed along the first direction D1 in a way that they are adjacent to one another at the second cuts 74*b*.

The short piece portion 72 and the long piece portion 73 each bend when they receive pressure from the developer 90. Since the long piece portion 73 is longer than the short piece portion 72, it is more easily bent.

In addition, the third width W3 of the long piece portion 73 is narrower than the first width W1 of the short piece portion 72. Accordingly, the long piece portion 73 is more easily bent.

In the present embodiment, the root portions of the short piece portions 72, and the root portions of the long piece portions 73, both connected to the base portion 71, are formed alternating in the first direction D1. With this configuration, the short piece portions 72 and the long piece portions 73 are disposed evenly in the first direction D1.

The long piece portions 73 include a plurality of intermediate long piece portions 73*a* and two outer long piece portions 73*b*. The intermediate long piece portions 73*a* are each positioned between every two consecutive short piece portions 72 in the first direction D1. On the other hand, the two outer long piece portions 73*b* are respectively positioned on the two ends of the base portion 71 in the first direction D1.

Each intermediate long piece portion 73*a* is formed in a shape that widens as it extends from its root portion that is connected to the base portion 71, toward the outer edges of the end portions, that are on the opposite side of the base portion 71, of its two neighboring short piece portions 72.

Figure 2:
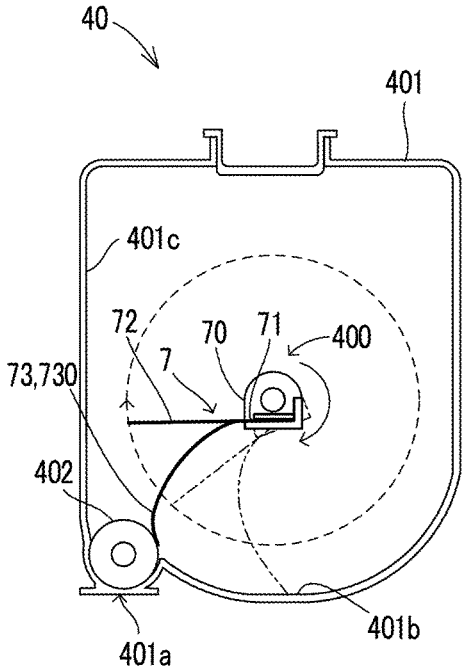
FIG. 2 is a diagram showing an inner configuration of a developer replenishing unit including a developer stirring member according to the first embodiment.

As shown in FIG. 2, the short piece portions 72 are each formed having a length such that it does not come in contact with the inner surface of the container 401 and the conveying screw 402. With this configuration, it is possible to prevent the firm short piece portions 72 from coming in strong contact with the inner surface of the container 401 and the conveying screw 402, and causing an unpleasant sound.

On the other hand, the long piece portions 73 are each formed having a length such that it comes in contact with a bottom surface 401*b* on the inner side of the container 401. That is, the long portion 730 is formed having a length such that it comes in contact with the inner side of the bottom surface 401*b* on the inner side of the container 401. With this configuration, when the amount of developer 90 inside the container 401 is low, the long piece portions 73 can flick up the developer 90 to the conveying screw 402.

It is noted that the long piece portion 73 may be formed having a length such that there is a small gap between the bottom surface 401*b* on the inner side of the container 401 and the conveying screw 402.

In addition, in the present embodiment, the long piece portions 73 are each formed having a length such that it comes in contact with the bottom surface 401*b* on the inner side of the container 401, and the conveying screw 402. With this configuration, when the amount of developer 90 inside the container 401 is low, the long piece portions 73 can more surely transport the developer 90 toward the conveying screw 402.

The long piece portions 73 are less firm and more flexible than the short piece portions 72. For this reason, as shown in FIG. 4B, when a relatively large amount of the developer 90 is stored inside the container 401, the long piece portions 73 bend greatly by receiving pressure from the developer 90. In this case, the long piece portions 73 do not contribute to the stirring of the developer 90.

On the other hand, when a relatively large amount of developer 90 is stored inside the container 401, the firm short piece portions 72 contribute to the stirring of the developer 90.

Figure 4A:
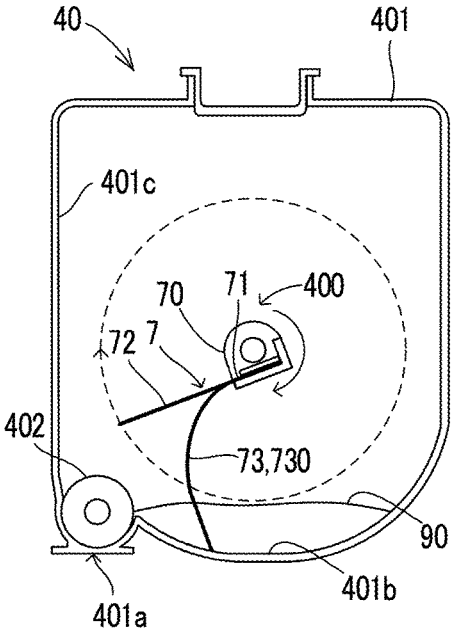
FIG. 4A and FIG. 4B are diagrams showing the developer stirring member according to the first embodiment in operation.
Figure 4B:
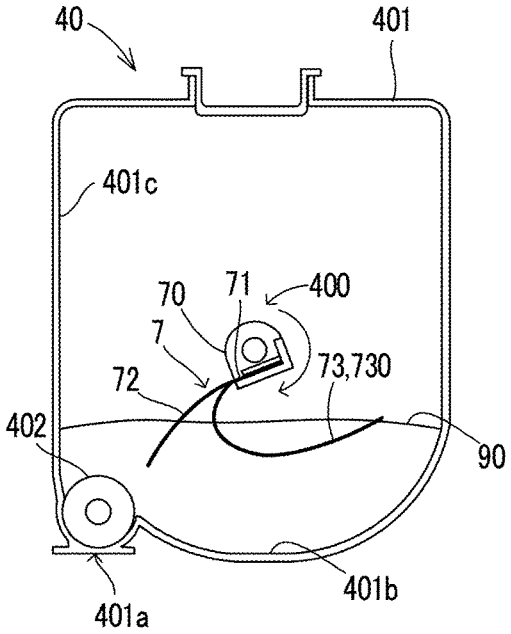

In addition, as shown in FIG. 4A, the degree of contribution of the short piece portions 72 to the stirring of the developer 90 becomes smaller as the amount of developer 90 inside the container 401 decreases. On the other hand, when the amount of developer 90 inside the container 401 is low, the long piece portions 73 mainly contribute to the stirring and flicking up of the developer 90.

According to the present embodiment, regardless of the amount of developer 90 stored inside the container 401, it is possible to stir the developer 90 inside the container 401 with an appropriate elastic force, while preventing the unpleasant noise. Furthermore, since the elasticity of the long portion 730 is not too strong, it is possible to prevent the developer 90 from becoming compacted on the bottom surface 401*b* of the container 401 due to pressure from the long portion 730.

Second Embodiment

Figure 5:
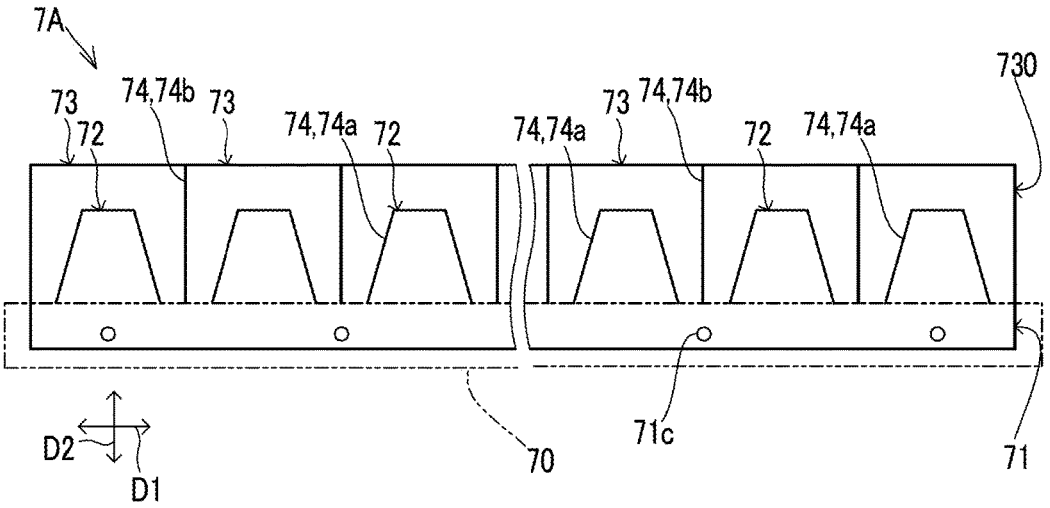
FIG. 5 is a partially abridged front diagram showing a flexible member included in a developer stirring member according to a second embodiment.

Next, with reference to FIG. 5, a developer stirring member according to a second embodiment is described. In FIG. 5, components in the present embodiment that correspond to those shown in FIG. 1 to FIG. 4 are denoted with the same reference symbols.

The developer stirring member according to the present embodiment includes the shaft member 70 and a flexible member 7A. The shaft member 70 has the same configuration in the first and second embodiments. In the following, features of the flexible member 7A that are different from the flexible member 7 are mainly described.

The flexible member 7A is different from the flexible member 7, shown in FIG. 3, only in the disposition and form of the long piece portions 73.

Similarly to the flexible member 7, in the flexible member 7A, the base portion 71, the short piece portions 72 and the long piece portions 73 are configured by one sheet of film material. In addition, the short piece portions 72 of the flexible member 7A have the same configuration as the short piece portions 72 of the flexible member 7.

The first cuts 74*a* divide the short piece portions 72 from the long piece portions 73. The second cuts 74*b* divide the long piece portions 73 from one another. In the present embodiment, the first cuts 74*a* and the second cuts 74*b* are formed separate from one another.

In the flexible member 7A, each long piece portion 73 is formed surrounding the outer edge of each short piece portion 72. Accordingly, the long piece portion 73 is connected to the base portion 71 at two places on both sides of the short piece portion 72. In addition, each second cut 74*b* is formed between every two consecutive short piece portions 72 in the first direction D1.

It is noted that in the flexible member 7A and the flexible member 7, the relationship is the same between the lengths of the short piece portions 72 and the long piece portions 73, and the inner surface of the container 401 and the conveying screw 402.

When the developer stirring member according to the present embodiment is adopted, the same effect as that of the developer stirring member 400 according to the first embodiment is achieved.

Third Embodiment

Figure 6:
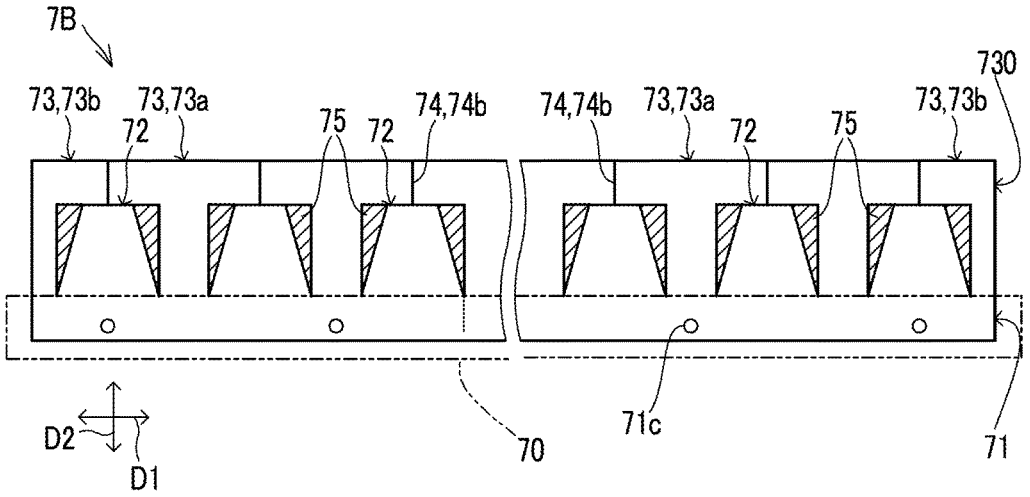
FIG. 6 is a partially abridged front diagram showing a flexible member included in a developer stirring member according to a third embodiment.

Next, with reference to FIG. 6, a developer stirring member according to a third embodiment is described. In FIG. 6, components in the present embodiment that correspond to those shown in FIG. 1 to FIG. 4 are denoted with the same reference symbols.

The developer stirring member according to the present embodiment includes the shaft member 70 and a flexible member 7B. The shaft member 70 has the same configuration in the first and third embodiments. In the following, features of the flexible member 7B that are different from the flexible member 7 are mainly described.

Similarly to the flexible member 7, in the flexible member 7B, the base portion 71, the short piece portions 72 and the long piece portions 73 are configured by one sheet of film material. In addition, the short piece portions 72 of the flexible member 7B have the same configuration as the short piece portions 72 of the flexible member 7.

In the flexible member 7B, the outlines of the short piece portions 72 and the outlines of the long piece portions 73, when viewed from a direction intersecting the first direction D1 and second direction D2, form a plurality of openings 75. For convenience, in FIG. 6, the openings 75 are marked with diagonal lines. It is noted that the direction intersecting the first direction D1 and second direction D2 is the direction that is perpendicular to the paper on which FIG. 6 is shown.

Similarly to flexible member 7, in flexible member 7B, each intermediate long piece portion 73*a* is formed in a shape that widens as it extends from its root portion that is connected to the base portion 71, toward the outer edges of the end portions, that are on the opposite side of the base portion 71, of its two neighboring short piece portions 72.

It is noted that in the flexible member 7B and the flexible member 7, the relationship is the same between the lengths of the short piece portions 72 and the long piece portions 73, and the inner surface of the container 401 and the conveying screw 402.

When the developer stirring member according to the present embodiment is adopted, the same effect as that of the developer stirring member 400 according to the first embodiment is achieved.

In addition, when the flexible member 7B is adopted, it is possible to adjust the flexibility of the long piece portions 73 by adjusting the size of the openings 75. That is, the larger the openings 75 are, the width of a portion of each long piece portion 73 that neighbors the short piece portion 72 in the first direction D1 is narrower, and thus the long piece portions 73 become more flexible.

Fourth Embodiment

Figure 7:
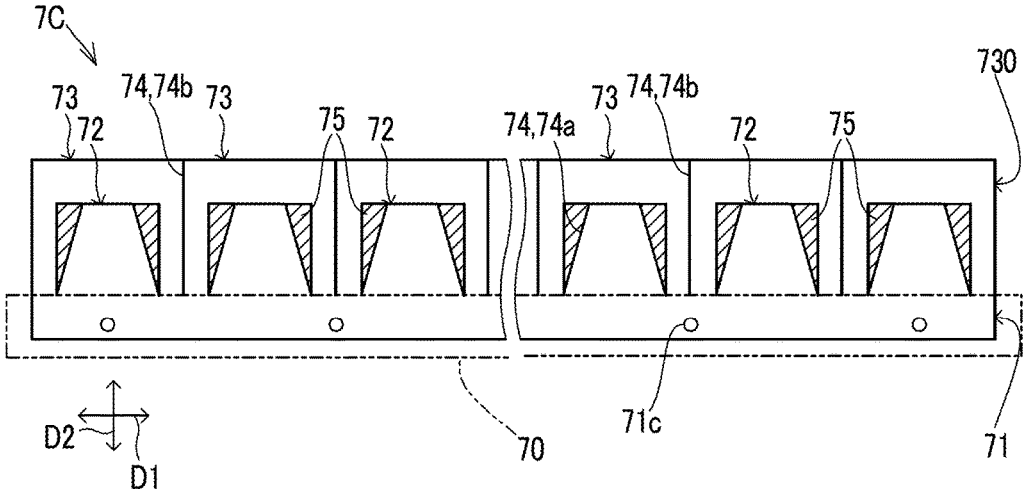
FIG. 7 is a partially abridged front diagram showing a flexible member included in a developer stirring member according to a fourth embodiment.

Next, with reference to FIG. 7, a developer stirring member according to a fourth embodiment is described. In FIG. 7, components in the present embodiment that correspond to those shown in FIG. 1 to FIG. 4 are denoted with the same reference symbols.

The developer stirring member according to the present embodiment includes the shaft member 70 and a flexible member 7C. The shaft member 70 has the same configuration in the first and fourth embodiments. In the following, features of the flexible member 7C that are different from the flexible member 7 are mainly described.

The flexible member 7C is an application example of the flexible member 7A shown in FIG. 5 and the flexible member 7B shown in FIG. 6. That is, the flexible member 7C is an example in which the openings 75 of the flexible member 7B are applied to the flexible member 7A.

Similarly to the flexible member 7, in the flexible member 7C, the base portion 71, the short piece portions 72 and the long piece portions 73 are configured by one sheet of film material. In addition, the short piece portions 72 of the flexible member 7C have the same configuration as the short piece portions 72 of the flexible member 7.

It is noted that in the flexible member 7C and the flexible member 7, the relationship is the same between the lengths of the short piece portions 72 and the long piece portions 73, and the inner surface of the container 401 and the conveying screw 402.

In the flexible member 7C, the outlines of the short piece portions 72 and the outlines of the long piece portions 73, when viewed from the direction intersecting the first direction D1 and second direction D2, form the openings 75. For convenience, in FIG. 7, the openings 75 are marked with diagonal lines.

In the flexible member 7C, each long piece portion 73 is formed surrounding the outer edge of each short piece portion 72. Accordingly, the long piece portion 73 is connected to the base portion 71 at two places on both sides of the short piece portion 72. In addition, each second cut 74*b* is formed between every two consecutive short piece portions 72 in the first direction D1.

When the developer stirring member according to the present embodiment is adopted, the same effect as that of the developer stirring member 400 according to the third embodiment is achieved.

Fifth Embodiment

Figure 8:
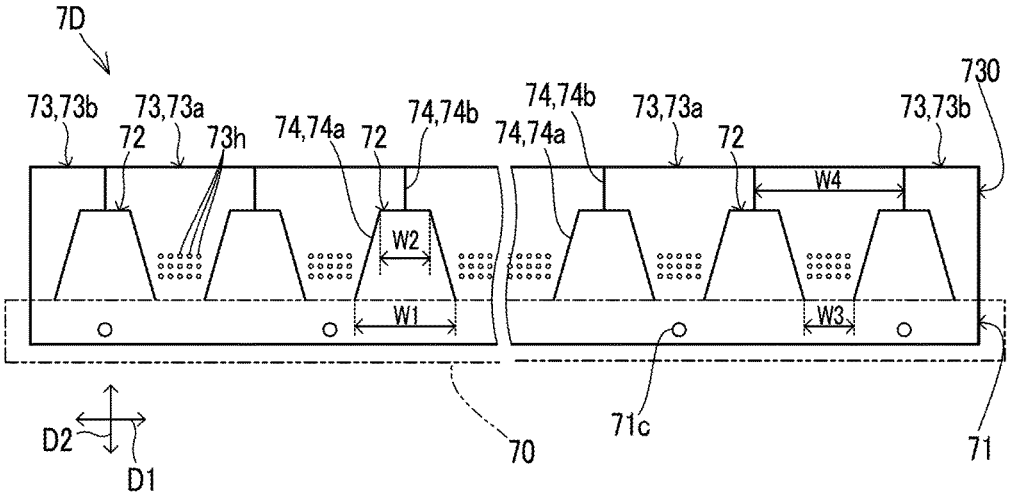
FIG. 8 is a partially abridged front diagram showing a flexible member included in a developer stirring member according to a fifth embodiment.

Next, with reference to FIG. 8, a developer stirring member according to a fifth embodiment is described. In FIG. 8, components in the present embodiment that correspond to those shown in FIG. 1 to FIG. 4 are denoted with the same reference symbols.

The developer stirring member according to the present embodiment includes the shaft member 70 and a flexible member 7D. The shaft member 70 has the same configuration in the first and fifth embodiments. In the following, features of the flexible member 7D that are different from the flexible member 7 are mainly described.

Similarly to the flexible member 7, in the flexible member 7D, the base portion 71, the short piece portions 72 and the long piece portions 73 are configured by one sheet of film material. In addition, the short piece portions 72 of the flexible member 7D have the same configuration as the short piece portions 72 of the flexible member 7.

It is noted that in the flexible member 7D and the flexible member 7, the relationship is the same between the lengths of the short piece portions 72 and the long piece portions 73, and the inner surface of the container 401 and the conveying screw 402.

In the flexible member 7D, one or more holes 73*h* are formed in a portion on the base portion 71 side of one or more of the long piece portions 73. That is, the one or more holes 73*h* are formed in a portion on the base portion 71 side of the long portion 730.

Similarly to flexible member 7, in flexible member 7D, each intermediate long piece portion 73*a* is formed in a shape that widens as it extends from its root portion that is connected to the base portion 71, toward the outer edges of the end portions, that are on the opposite side of the base portion 71, of its two neighboring short piece portions 72.

When the developer stirring member according to the present embodiment is adopted, the same effect as that of the developer stirring member 400 according to the first embodiment is achieved.

In addition, when the flexible member 7D is adopted, it is possible to adjust the flexibility of the long piece portions 73 by adjusting the size and number of the holes 73*h*.

It is noted that an application example may be adopted where the one or more holes 73*h* are formed in the flexible member 7A shown in FIG. 5, the flexible member 7B shown in FIG. 6, or the flexible member 7C shown in FIG. 7.

In addition, the portion on the base portion 71 side of the long portion 730 may include neck portions that are narrower than other portions of the long portion 730. In addition, the portion on the base portion 71 side of the long portion 730 may include cuts that extend along the first direction D1. It is possible to adjust the flexibility of the long piece portions 73 by adjusting the width of the neck portions and the length of the cuts along the first direction D1.

Sixth Embodiment

Figure 9:
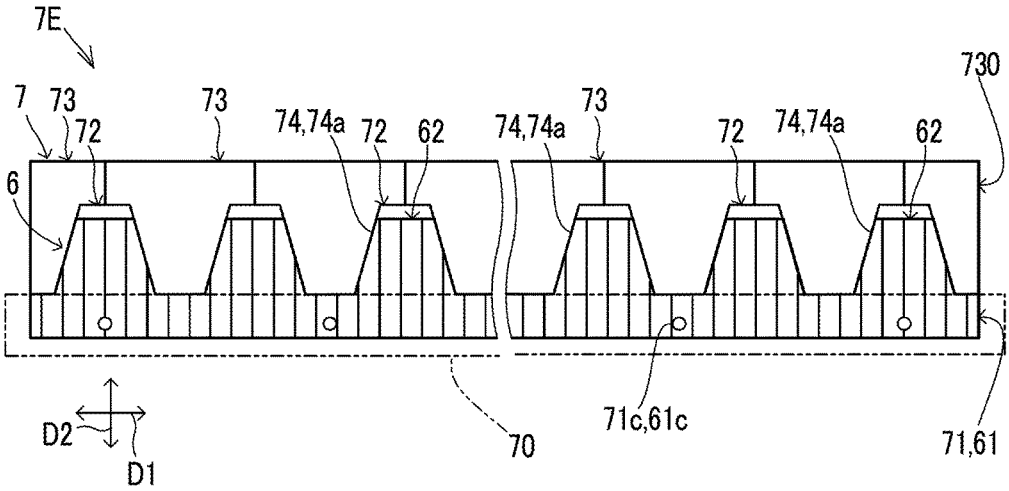
FIG. 9 is a partially abridged front diagram showing a flexible member included in a developer stirring member according to a sixth embodiment.
Figure 10:
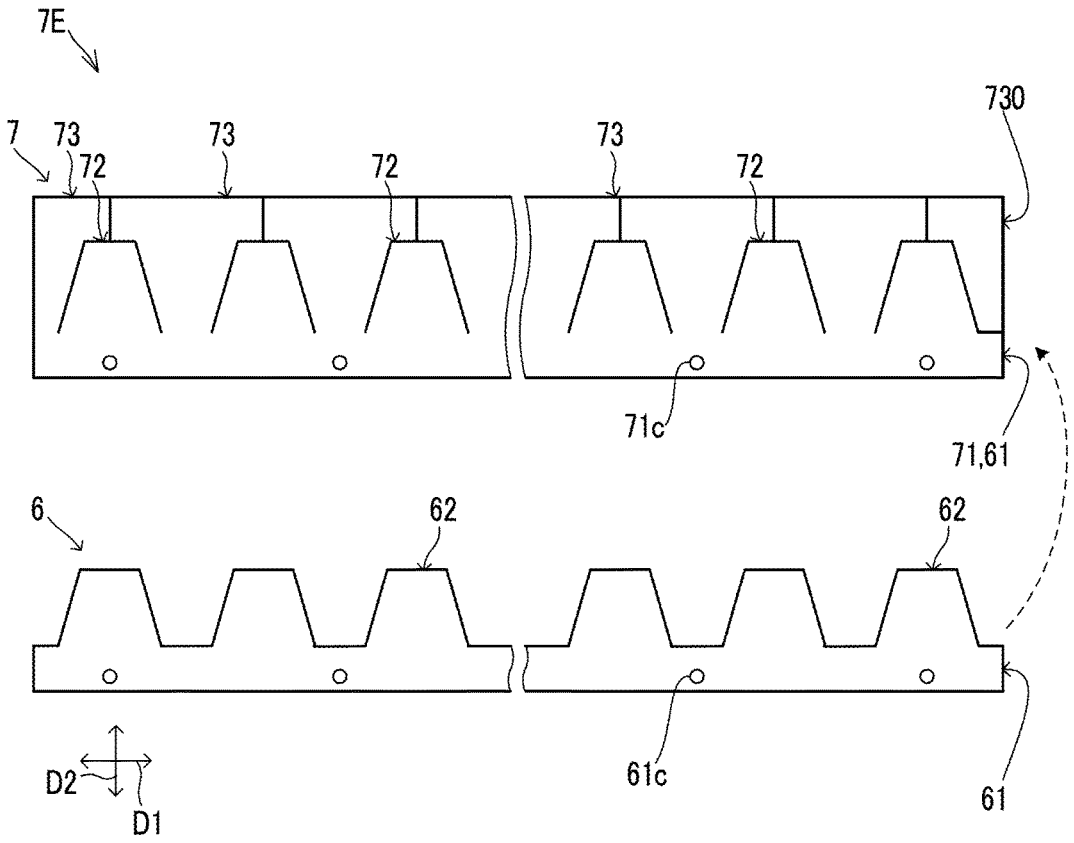
FIG. 10 is a partially abridged front diagram showing a first film material and a second film material included in the flexible member of the developer stirring member according to the sixth embodiment.

Next, with reference to FIG. 9 and FIG. 10, a developer stirring member according to a sixth embodiment is described. In FIG. 9 and FIG. 10, components in the present embodiment that correspond to those shown in FIG. 1 to FIG. 4 are denoted with the same reference symbols.

The developer stirring member according to the present embodiment includes the shaft member 70 and a flexible member 7E. The shaft member 70 has the same configuration in the first and sixth embodiments. In the following, features of the flexible member 7E that are different from the flexible member 7 are mainly described.

As shown in FIG. 10, the flexible member 7E includes the flexible member 7 and a superposed member 6. The flexible member 7 and the superposed member 6 are each one sheet of film material. It is noted that the flexible member 7 is an example of a first film material, and the superposed member 6 is an example of a second film material.

Similarly to the flexible member 7, the superposed member 6 is made by forming a synthetic resin such as PET, vinyl chloride, or polycarbonate, in a film-like shape.

The flexible member 7 and the superposed member 6 may or may not be made of the same material.

In addition, the flexible member 7 and the superposed member 6 may or may not have the same thickness.

As described above, the flexible member 7 includes the base portion 71, the short piece portions 72, and the long piece portions 73. The superposed member 6 is a member that is superposed on the surface, on an upstream side in the rotational direction of the shaft member 70, of the base portion 71 and short piece portions 72 of the flexible member 7. The superposed member 6 is an example of a superposed portion.

For convenience, in FIG. 9, the superposed member 6 superposed on the flexible member 7 is marked with vertical stripes. The superposed member 6 includes a superposed base portion 61 that is superposed on the base portion 71 of the flexible member 7, and a plurality of superposed piece portions 62 that are superposed on the short piece portions 72 of the flexible member 7.

A plurality of holes 61*c* that overlap with the holes 71*c* in the base portion 71 of the flexible member 7, are formed in the superposed base portion 61 of the superposed member 6.

In the example shown in FIG. 9, each superposed piece portion 62 has a length in the second direction D2 that is shorter than that of each short piece portion 72. However, some or all of the superposed piece portions 62 may each have a length in the second direction D2 that is the same as that of its corresponding short piece portion 72, on which it is superposed.

In addition, the width of each superposed piece portion 62 in the first direction D1 may be shorter than or the same as that of the corresponding short piece portion 72.

In the developer stirring member according to the present embodiment, the base portion 71 of the flexible member 7 and the superposed base portion 61 of the superposed member 6 are fixed to the shaft member 70. In FIG. 9, the shaft member 70 is shown with an imaginary line.

When the developer stirring member according to the present embodiment is adopted, the same effect as that of the developer stirring member 400 according to the first embodiment is achieved.

In addition, by adopting the flexible member 7E, the short piece portions 72 are reinforced by the superposed member 6. With this configuration, it is possible to improve the stirring ability of the short piece portions 72 when a relatively large amount of developer 90 is stored inside the container 401.

Furthermore, by adopting the flexible member 7E, it is possible to adjust the flexibility of the short piece portions 72 by adjusting the respective sizes of the superposed piece portions 62 in the first direction D1 and second direction D2. Similarly, it is possible to adjust the flexibility of the short piece portions 72 by adjusting the thickness of the superposed member 6.

In addition, an application example may be adopted where the superposed member 6 is superposed on the flexible member 7A shown in FIG. 5, the flexible member 7B shown in FIG. 6, the flexible member 7C shown in FIG. 7, or the flexible member 7D shown in FIG. 8.

Seventh Embodiment

Figure 11:
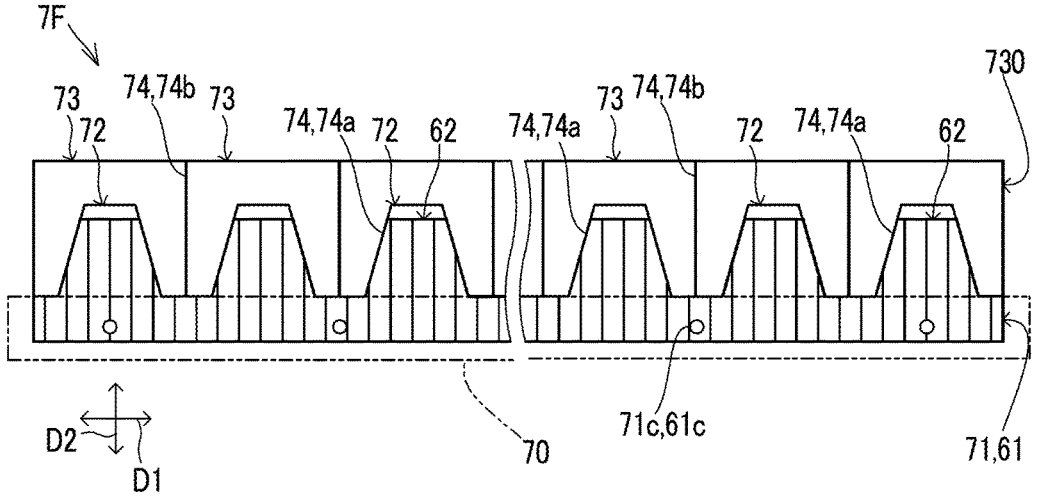
FIG. 11 is a partially abridged front diagram showing a flexible member included in a developer stirring member according to a seventh embodiment.
Figure 12:
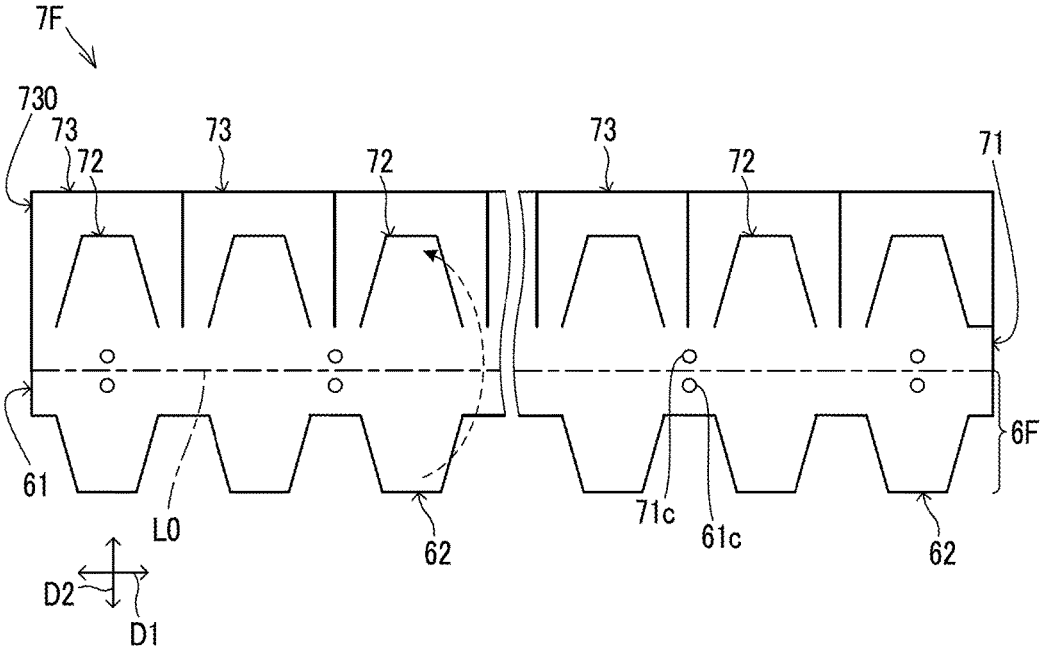
FIG. 12 is an expanded diagram showing the flexible member included in the developer stirring member according to the seventh embodiment.

Next, with reference to FIG. 11 and FIG. 12, a developer stirring member according to a seventh embodiment is described. In FIG. 11 and FIG. 12, components in the present embodiment that correspond to those shown in FIG. 1 to FIG. 4, FIG. 9, and FIG. 10 are denoted with the same reference symbols.

The developer stirring member according to the present embodiment includes the shaft member 70 and a flexible member 7F. The shaft member 70 has the same configuration in the first and seventh embodiments. The flexible member 7F is an application example of the flexible member 7E.

In the following, features of the flexible member 7F that are different from the flexible member 7 and the flexible member 7E are mainly described.

As shown in FIG. 12, the flexible member 7F has a configuration in which a superposed member 6F is added to the flexible member 7A shown in FIG. 5. In the flexible member 7F, the base portion 71, the short piece portions 72, the long piece portions 73, and the superposed member 6F are configured by one sheet of film material.

The superposed member 6F is a portion that is superposed on the base portion 71 and the short piece portions 72, in such a manner that the superposed member 6F is folded over along a boundary L0 between itself and the base portion 71. Similarly to the superposed member 6, the superposed member 6F is superposed on the surface, on an upstream side in the rotational direction of the shaft member 70, of the base portion 71 and short piece portions 72.

For convenience, in FIG. 11, the superposed member 6F that is superposed on the base portion 71 and the short piece portions 72 is marked with vertical stripes the superposed member 6F includes the superposed base portion 61 that is superposed on the base portion 71 of the flexible member 7, and the plurality of superposed piece portions 62 that are superposed on the short piece portions 72 of the flexible member 7.

The plurality of holes 61*c* that overlap with the holes 71*c* in the base portion 71 are formed in the superposed base portion 61. That is, the flexible member 7F according to the present embodiment corresponds to a configuration in which the flexible member 7 and superposed member 6 according to the sixth embodiment are formed by one sheet of film material. The superposed member 6F of the flexible member 7F corresponds to the superposed member 6 according to the sixth embodiment.

In the example shown in FIG. 11, each superposed piece portion 62 has a length in the second direction D2 that is shorter than that of each short piece portion 72. However, some or all of the superposed piece portions 62 may each have a length in the second direction D2 that is the same as that of its corresponding short piece portion 72, on which it is superposed.

In addition, the width of each superposed piece portion 62 in the first direction D1 may be shorter than or the same as that of the corresponding short piece portion 72.

In the example shown in FIG. 11, the superposed piece portions 62 are each formed in a way that its size in the first direction D1 becomes narrower as it extends in the second direction D2 from the superposed base portion 61 side toward the opposite side. With this configuration, the distribution of flexibility of the short piece portion 72 in the second direction D2 is adjusted.

In the developer stirring member according to the present embodiment, the base portion 71 and the superposed base portion 61 that is superposed on the base portion 71 are fixed to the shaft member 70. In FIG. 11, the shaft member 70 is shown with an imaginary line.

When the developer stirring member according to the present embodiment is adopted, the same effect as that of the developer stirring member according to the sixth embodiment is achieved.

In addition, by adopting the flexible member 7F, it is possible to reinforce the short piece portions 72 without using additional parts.

In addition, an application example may be adopted where the superposed member 6F is added to the flexible member 7 shown in FIG. 3, the flexible member 7B shown in FIG. 6, the flexible member 7C shown in FIG. 7, or the flexible member 7D shown in FIG. 8.

Eighth Embodiment

Figure 13:
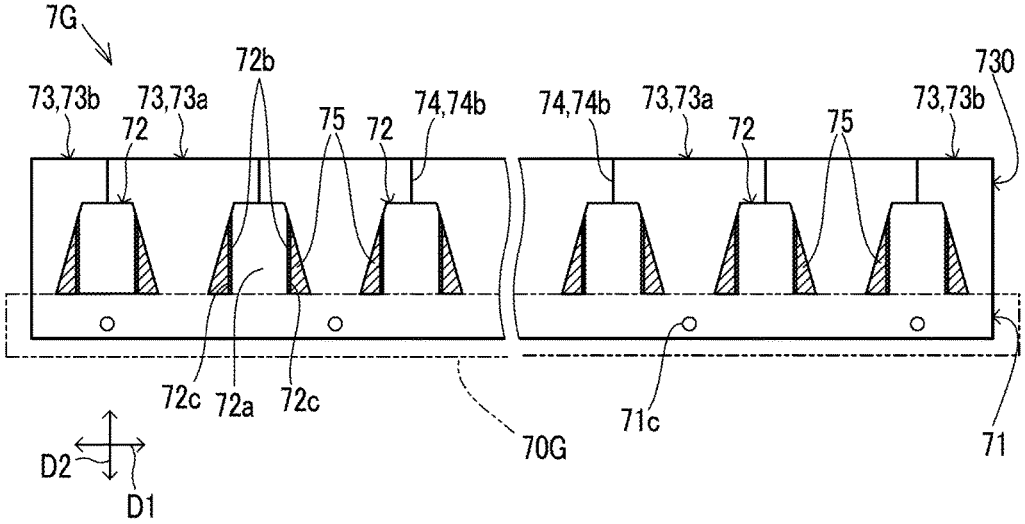
FIG. 13 is a partially abridged front diagram showing a flexible member included in a developer stirring member according to an eighth embodiment.

Next, with reference to FIG. 13 and FIG. 14, a developer stirring member 400G according to an eighth embodiment is described. In FIG. 13 and FIG. 14, components in the present embodiment that correspond to those shown in FIG. 1 to FIG. 4, and FIG. 6 are denoted with the same reference symbols.

The developer stirring member according to the present embodiment includes a shaft member 70G and a flexible member 7G. In the following, features of the flexible member 7G that are different from the flexible member 7 and the flexible member 7B are mainly described.

As shown in FIG. 13 and FIG. 14, the flexible member 7G has a configuration in which portions in each short piece portion 72 of the flexible member 7 shown in FIG. 3 have been cut and raised.

In the flexible member 7G, at least one of the plurality of short piece portions 72 includes a main surface portion 72*a* and one or more raised portions 72*b*. In the example shown in FIG. 13, all of the short piece portions 72 each include the main surface portion 72*a* and two raised portions 72*b*, but the short piece portions 72 are not limited to this configuration.

The main surface portion 72*a* is a surface that extends in the first direction D1 and second direction D2. Each raised portion 72*b* is a ridge that extends, along the second direction D2, from the main surface portion 72*a* via a bent portion 72*c*.

Figure 14A:
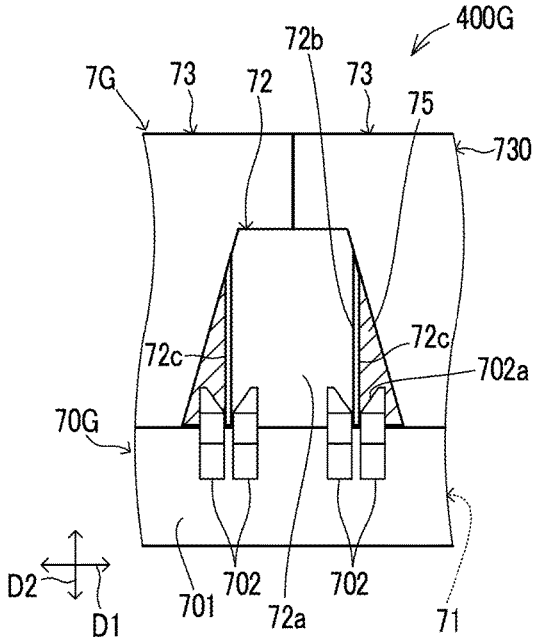
FIG. 14A is a partially abridged front diagram showing the developer stirring member according to the eighth embodiment.
Figure 14B:
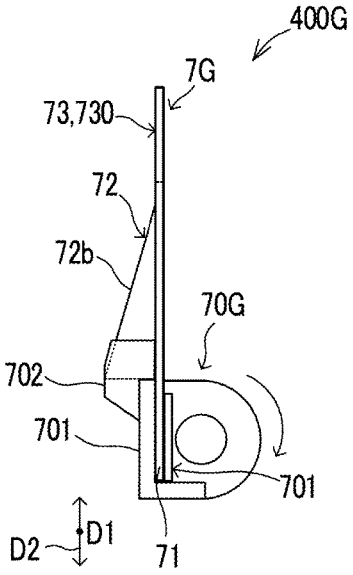
FIG. 14B is a side-view diagram showing the developer stirring member according to the eighth embodiment.

The raised portion 72*b* is raised from the main surface portion 72*a* of a surface, on an upstream side in the rotational direction of the shaft member 70G, of the flexible member 7G (see FIG. 14B).

Similarly to the flexible member 7, in the flexible member 7G, the base portion 71, the short piece portions 72 and the long piece portions 73 are configured by one sheet of film material. The raised portion 72*b* is a portion that is cut and raised from film-like parent material.

Accordingly, in the flexible member 7G, the outlines of the short piece portions 72 and the outlines of the long piece portions 73, when viewed from the direction intersecting the first direction D1 and second direction D2, form the plurality of openings 75. For convenience, in FIG. 13 and FIG. 14A, the openings 75 are marked with diagonal lines.

When the developer stirring member 400G is adopted, the same effect as that of the developer stirring member 400 is achieved.

In addition, by adopting the flexible member 7G, it is possible to reinforce the short piece portions 72 without using additional parts.

In the present embodiment, the raised portion 72*b* is formed in a range, on the short piece portion 72, that starts from the root portion on the base portion 71 side and ends before reaching an end portion on the opposite side of the base portion 71. With this configuration, the end portion of the short piece portion 72 has relatively high flexibility.

In addition, as shown in FIG. 14B, the portion of the raised portion 72*b* on the base portion 71 side is formed higher than the portion on the opposite side of the base portion 71. With this configuration, the distribution of flexibility of the short piece portion 72 in the second direction D2 is adjusted.

As shown in FIG. 14, the shaft member 70G is provided with a holding portion 701 and an engaging portion 702. The holding portion 701 is for holding the base portion 71 of the flexible member 7G. It is noted that the shaft members 70 according to the other embodiments also include the holding portion 701.

The engaging portion 702, by engaging with a portion of the raised portion 72*b*, holds the raised portion 72*b* in the state where it is raised from the main surface portion 72*a*.

In the example shown in FIG. 14A, the engaging portion 702 is formed in a notched shape in which a portion of the raised portion 72*b* is inserted. Furthermore, the engaging portion 702 includes a tapered guiding surface 702*a* whose width narrows from the open side to the inner side of the raised portion 72*b*. With this configuration, it is possible to easily insert the raised portion 72*b* in the notch-shaped engaging portion 702.

When the developer stirring member 400 according to the present embodiment is adopted, the same effect as that of the developer stirring member according to the seventh embodiment is achieved. In addition, the raised portion 72*b* has high reinforcement ability of the short piece portion 72.

In addition, an application example may be adopted where the raised portion 72*b* is applied to the flexible member 7A shown in FIG. 5, the flexible member 7B shown in FIG. 6, the flexible member 7C shown in FIG. 7, the flexible member 7D shown in FIG. 8, the flexible member 7E shown in FIG. 9, or the flexible member 7G shown in FIG. 11.

Ninth Embodiment

Figure 15:
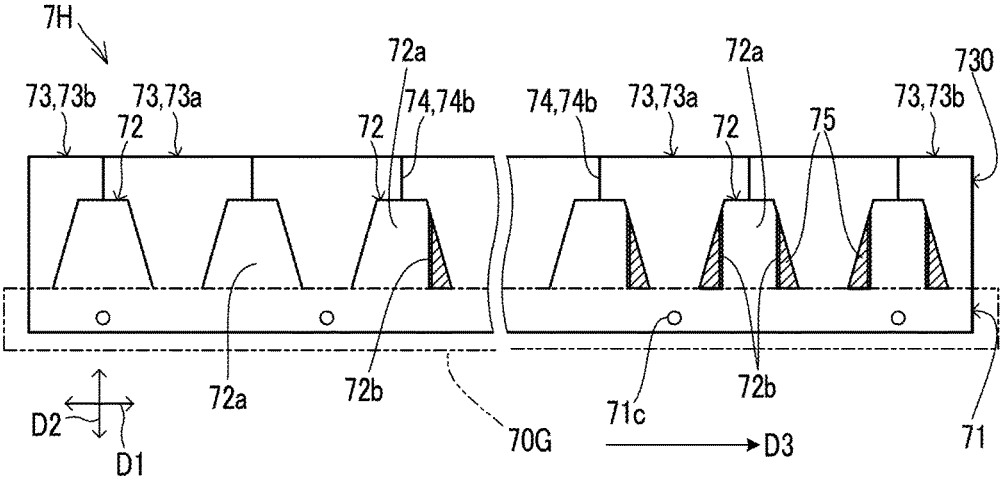
FIG. 15 is a partially abridged front diagram showing a flexible member included in a developer stirring member according to a ninth embodiment.

Next, with reference to FIG. 15, a developer stirring member according to a ninth embodiment is described. The developer stirring member according to the present disclosure is an application example of the developer stirring member 400G. In FIG. 15, components in the present embodiment that correspond to those shown in FIG. 1 to FIG. 4, FIG. 13, and FIG. 14 are denoted with the same reference symbols.

The developer stirring member according to the present embodiment includes the shaft member 70G and a flexible member 711. In the following, features of the flexible member 711 that are different from the flexible member 7G are mainly described.

As shown in FIG. 15, among the short piece portions 72 of the flexible member 711, some of the short piece portions 72 include two raised portions 72*b*, and some of the short piece portions 72 include only one raised portion 72*b*.

Furthermore, among the short piece portions 72 of the flexible member 711, some of the short piece portions 72 do not include the raised portion 72*b*.

Similarly to the flexible member 7G, in the flexible member 711, at least one of the short piece portions 72 includes the main surface portion 72*a* and one or more raised portions 72*b*. In the example shown in FIG. 15, among the plurality of short piece portions 72, some short piece portions 72 include the main surface portion 72*a* and two raised portions 72*b*, some include the main surface portion 72*a* and one raised portion 72*b*, and some include the main surface portion 72*a* and no raised portions 72*b*.

The main surface portion 72*a* is a surface that extends in the first direction D1 and second direction D2. Each raised portion 72*b* is a ridge that extends, along the second direction D2, from the main surface portion 72*a* via a bent portion 72*c*.

As shown in FIG. 2, a discharge port 401*a* for the developer 90 is formed in the container 401. The discharge port 401*a* is formed at a position on a first end side of the container 401 in the first direction D1. One end of the conveying screw 402 is positioned above the discharge port 401*a*.

The conveying screw 402 conveys the developer 90 from a second end side of the container 401 in the first direction D1, to the first end side. With this configuration, the developer 90 that is conveyed by the conveying screw 402 falls down, through the discharge port 401*a*, below the container 401.

Hereinafter, the conveyance direction of the developer 90 by the conveying screw 402 is referred to as a developer conveyance direction D3 (see FIG. 15). The developer conveyance direction D3 extends along the first direction D1.

In the flexible member 7G, among the plurality of short piece portions 72, the short piece portions 72 that each include two raised portions 72*b* are positioned more downstream in the developer conveyance direction D3 than other short piece portions 72 that each include one short piece portion 72.

In addition, the short piece portions 72 that do not include the raised portion 72*b* are positioned more upstream in the developer conveyance direction D3 than the other short piece portions 72 that include the raised portion 72*b*.

When the developer stirring member according to the present embodiment is adopted, the same effect as that of the developer stirring member according to the eighth embodiment is achieved.

In addition, when the flexible member 7G, on which the raised portions 72*b* are disposed as described above, revolves, the short piece portions 72 stir the developer 90 and convey it upstream in the developer conveyance direction D3. With this configuration, the developer 90 inside the container 401 is more efficiently stirred.

Tenth Embodiment

Figure 16:
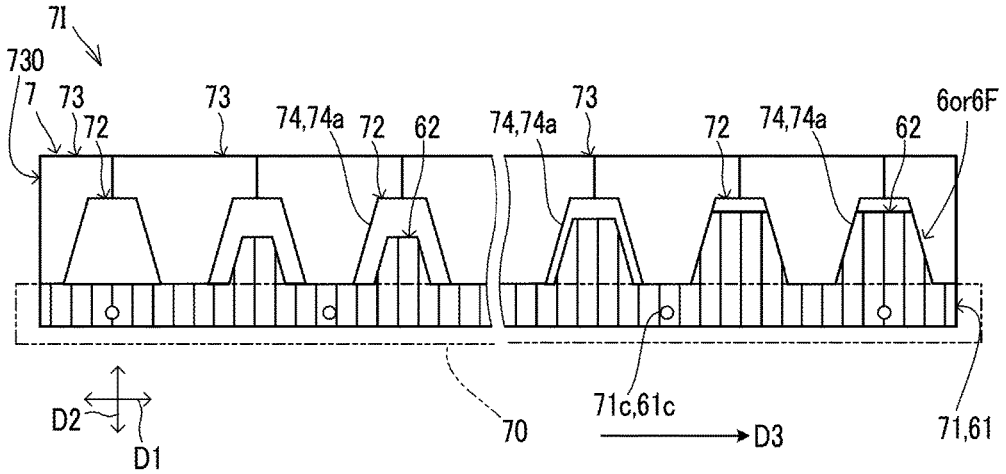
FIG. 16 is a partially abridged front diagram showing a flexible member included in a developer stirring member according to a tenth embodiment.

Next, with reference to FIG. 16, a developer stirring member according to a tenth embodiment is described. The developer stirring member according to the present disclosure is an application example of the flexible member 7E shown in FIG. 9, or the flexible member 7F shown in FIG. 11.

In FIG. 16, components in the present embodiment that correspond to those shown in FIG. 1 to FIG. 4, and FIG. 9 to FIG. 12 are denoted with the same reference symbols.

The developer stirring member according to the present embodiment includes the shaft member 70 and a flexible member 71. In the following, features of the flexible member 71 that are different from the flexible member 7E and the flexible member 7F are mainly described.

The flexible member 71 includes a plurality of superposed piece portions 62 that have different areas. The example shown in FIG. 16 includes one short piece portion 72 on which the superposed piece portion 62 is not superposed.

In the present embodiment, among the plurality of superposed piece portions 62, the superposed piece portions 62 with larger areas are positioned downstream in the developer conveyance direction D3 than the superposed piece portions 62 with smaller areas.

Similarly to the flexible member 7G shown in FIG. 15, the short piece portions 72 on the flexible member 71 stir the developer 90 and convey it upstream in the developer conveyance direction D3. When the developer stirring member according to the present embodiment is adopted, the same effect as that of the developer stirring member according to the ninth embodiment is achieved.

Application Example

The flexible members 7, 7A, 7B, 7C, 7D, 7E, 7F, 7G, 7H, and 7I may not include the second cuts 74*b*, that is, the long portion 730 may not be divided into the plurality of long piece portions 73.

It is noted that the developer stirring member and the developer replenishing unit according to the present disclosure may have configurations, within the scope of the disclosure defined by the claims, in which the embodiments and application examples described above are combined, or the embodiments and application examples are modified or partially abridged as needed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims

The invention claimed is:

1. A developer stirring member, comprising:

a shaft member elongated in a first direction and rotatably supported inside a container for storing powdery developer; and a film-like flexible member supported by the shaft member and configured to stir the developer, wherein the flexible member includes a base portion elongated in the first direction and fixed to the shaft member, a plurality of short piece portions, each extending from the base portion in a second direction that intersects the first direction, that are juxtaposed in the first direction with spaces in between one another, a long portion having a length that is longer in the second direction than the short piece portions, and extending in the second direction from portions of the base portion that are in between where the short piece portions are connected to the base portion, and the base portion, the short piece portions, and the long portion are made of one sheet of film material.

2. The developer stirring member according to claim 1, wherein in each of the short piece portions, a root portion that is connected to the base portion is larger in the first direction than an end portion that is on an opposite side of the base portion.

3. The developer stirring member according to claim 1, wherein the long portion is divided into a plurality of long piece portions by a plurality of cuts that are cut into an end portion, on an opposite side of the base portion side, of the long portion.

4. The developer stirring member according to claim 3, wherein a root portion, connected to the base portion, of each of the long piece portions is smaller in the first direction than a root portion, connected to the base portion, of each of the short piece portions.

5. The developer stirring member according to claim 3, wherein a plurality of root portions, connected to the base portion, of the short piece portions, and a plurality of root portions, connected to the base portion, of the long piece portions are formed alternating one after the other in the first direction, and the plurality of long piece portions includes an intermediate long piece portion that is positioned between two consecutive short piece portions, and formed in a shape that widens from a root portion that is connected to the base portion, toward outer edges of end portions, on an opposite side of the base portion side, of the two short piece portions.

6. The developer stirring member according to claim 3, wherein each of the plurality of long piece portions is formed surrounding an outer edge of each of the plurality of short piece portions.

7. The developer stirring member according to claim 1, wherein when viewed from a direction that perpendicularly intersects the first direction and the second direction, outlines of the short piece portions and an outline of the long portion form a plurality of openings.

8. The developer stirring member according to claim 1, wherein one or more holes are formed in a portion on the base portion side of the long portion.

9. The developer stirring member according to claim 1, wherein at least one of the short piece portions includes a main surface portion that is a surface extending along the first direction and the second direction, and one or more raised portions that are each a ridge that extends along the second direction from the main surface portion via a bent portion.

10. The developer stirring member according to claim 9, wherein each of the raised portions are formed in a range, in each of the short piece portions, that starts from a root portion on the base portion side, and ends before reaching an end portion on an opposite side of the base portion.

11. The developer stirring member according to claim 9, further comprising an engaging portion that is provided on the shaft member, and configured to engage with a portion of each of the raised portions and hold the raised portion in a state where the raised portion is raised from the main surface portion.

12. The developer stirring member according to claim 9, wherein in the raised portion, a portion on the base portion side is formed higher than a portion on an opposite side of the base portion.

13. The developer stirring member according to claim 9, wherein the plurality of short piece portions includes one or more short piece portions having two raised portions, and one or more short piece portions having only one raised portion.

14. The developer stirring member according to claim 13, wherein the plurality of short piece portions further includes one or more short piece portions having no raised portions.

15. The developer stirring member according to claim 1, further comprising one sheet of first film material including the base portion, the plurality of short piece portions, and the long portion, and one sheet of second film material superposed on a surface, on an upstream side in a rotational direction of the shaft member, of the base portion and plurality of short piece portions of the first film material, wherein the base portion of the first film material, and a portion of the second film material that is superposed on the base portion of the first film material, are fixed to the shaft member.

16. The developer stirring member according to claim 1, further comprising a superposed portion that is superposed on a surface, on an upstream side in a rotational direction of the shaft member, of the base portion and plurality of short piece portions, in such a manner that the superposed portion is folded over a boundary between the superposed portion and the base portion, wherein the base portion, the plurality of short piece portions, the long portion and the superposed portion are configured by one sheet of film material, and the base portion and a portion of the superposed portion that is superposed on the base portion are fixed to the shaft member.

17. A developer replenishing unit, comprising:

a container configured to store powdery developer;

the developer stirring member according to claim 1 configured to stir the developer by being rotationally driven inside the container; and a developer feeding member configured to feed out the developer from the container by being rotationally driven inside the container, wherein the plurality of short piece portions are each formed having a length such that the short piece portion does not come in contact with an inner surface of the container.

18. The developer replenishing unit according to claim 17, wherein the long portion is formed having a length such that the long portion comes in contact with a bottom surface on an inner side of the container.

19. The developer replenishing unit according to claim 17, wherein the long portion is formed having a length such that the long portion comes in contact with a bottom surface on an inner side of the container, and with the developer feeding member.

20. An image forming apparatus, comprising:

a developing device configured to develop, using developer, an electrostatic latent image on a surface of an image-carrying member; and the developer replenishing unit according to claim 17 configured to replenish the developing device with developer.

* * * * *